US007591608B2

(12) United States Patent
Hall et al.

(10) Patent No.: US 7,591,608 B2
(45) Date of Patent: Sep. 22, 2009

(54) CHECKING DENSITY WHILE COMPACTING

(76) Inventors: David R. Hall, 2185 S. Larsen Pkwy., Provo, UT (US) 84606; Tyson J. Wilde, 2185 S. Larsen Pkwy., Provo, UT (US) 84606; Jacob S. Waldron, 2185 S. Larsen Pkwy., Provo, UT (US) 84606

( * ) Notice: Subject to any disclaimer, the term of this patent is extended or adjusted under 35 U.S.C. 154(b) by 573 days.

(21) Appl. No.: 11/427,597

(22) Filed: Jun. 29, 2006

(65) Prior Publication Data

US 2008/0003057 A1 Jan. 3, 2008

(51) Int. Cl.
*E01C 23/00* (2006.01)

(52) U.S. Cl. ..... 404/84.1; 404/133.05

(58) Field of Classification Search ..... 404/84.05, 404/84.1, 122, 133.05
See application file for complete search history.

(56) References Cited

U.S. PATENT DOCUMENTS

| | | | | |
|---|---|---|---|---|
| 1,887,341 | A | | 11/1932 | Venable |
| 1,898,158 | A | | 2/1933 | Winkle |
| 2,039,078 | A | | 4/1936 | Hertwig |
| 2,098,895 | A | | 11/1937 | Velten |
| 2,633,782 | A | | 4/1953 | Cement |
| 2,893,299 | A | | 7/1959 | Moir |
| 2,908,206 | A | | 10/1959 | Melanson |
| 2,938,438 | A | | 5/1960 | Hamilton |
| 3,075,436 | A | | 1/1963 | McRae |
| 3,361,042 | A | | 1/1968 | Cutler |
| 3,732,023 | A | | 5/1973 | Rank |
| 3,817,644 | A | | 6/1974 | Matson |
| 3,970,404 | A | | 7/1976 | Benedetti |
| 3,989,401 | A | | 11/1976 | Moench |
| 4,018,540 | A | | 4/1977 | Jackson |
| 4,104,736 | A | | 8/1978 | Mendenhall |
| 4,124,325 | A | | 11/1978 | Cutler |
| 4,127,351 | A | | 11/1978 | Vural |
| 4,149,253 | A | * | 4/1979 | Paar et al. ..... 701/50 |
| 4,172,679 | A | | 10/1979 | Wirtgen |
| 4,195,946 | A | | 4/1980 | Swisher |
| 4,215,949 | A | | 8/1980 | Gabriel, Jr. |
| 4,261,669 | A | | 4/1981 | Edo |
| 4,313,690 | A | | 2/1982 | Hojbjerg |
| 4,335,975 | A | | 6/1982 | Schoelkopf |
| 4,347,016 | A | | 8/1982 | Sindelar et al. |

(Continued)

OTHER PUBLICATIONS

U.S. Appl. No. 11/421,105, filed May 31, 2006, Hall.

*Primary Examiner*—Gary S Hartmann
(74) *Attorney, Agent, or Firm*—Tyson J. Wilde

(57) ABSTRACT

A compaction system, including a first and second array of compaction elements supported by an underside of a motorized vehicle adapted to traverse a degraded surface. A sensor assembly is supported by the motorized vehicle, disposed intermediate the first and second array of compaction elements, and in electrical communication with a controller. The sensor assembly also being adapted to sense a characteristic of an at least partially compacted surface formed after the first array of compacting elements applies a first compaction pressure to the degraded surface. The controller being in electrical communication with the second array of compaction elements and has an input field for a second compaction pressure. The sensor assembly is adapted to input the second compaction pressure into the field and the controller is adapted to adjust the second array of compaction elements to apply the second compaction pressure to the at least partially compacted surface.

14 Claims, 11 Drawing Sheets

U.S. PATENT DOCUMENTS 4,407,605 A 10/1983 Wirtgen
4,473,320 A 9/1984 Register
4,534,674 A 8/1985 Cutler
4,594,022 A 6/1986 Jeppson
4,668,017 A 5/1987 Peterson
4,676,689 A 6/1987 Yant
4,692,350 A 9/1987 Clarke
4,784,518 A 11/1988 Cutler
4,793,730 A 12/1988 Butch
4,968,101 A 11/1990 Bossow
4,979,197 A * 12/1990 Troxler et al. ..... 378/90
5,116,162 A * 5/1992 Burhite ..... 404/72
5,131,788 A 7/1992 Hulicsko
5,366,320 A 11/1994 Hanlon
5,556,225 A 9/1996 Marino
5,588,776 A * 12/1996 Swisher et al. ..... 404/72
5,745,051 A * 4/1998 Doherty et al. ..... 340/905
5,765,926 A 6/1998 Knapp
5,791,814 A 8/1998 Wiley
5,900,736 A * 5/1999 Sovik et al. ..... 324/663
5,947,636 A 9/1999 Mara
5,947,638 A 9/1999 Heims
5,951,561 A 9/1999 Pepper
5,952,561 A * 9/1999 Jaselskis et al. ..... 73/78
6,122,601 A 9/2000 Swanson
6,158,920 A 12/2000 Malot
6,287,048 B1 9/2001 Hollon
6,371,689 B1 4/2002 Wiley
6,414,497 B1 * 7/2002 Sovik et al. ..... 324/663
6,460,006 B1 * 10/2002 Corcoran ..... 702/137
6,551,018 B2 4/2003 Baker
6,577,141 B2 6/2003 Gandrud
6,623,207 B2 9/2003 Grubba
6,769,836 B2 8/2004 Lloyd
6,799,922 B2 10/2004 Smith
6,803,771 B2 * 10/2004 Sovik et al. ..... 324/654
6,846,354 B2 1/2005 Larsen
6,973,821 B2 * 12/2005 Corcoran ..... 73/78
7,223,049 B2 * 5/2007 Hall et al. ..... 404/93
7,226,239 B2 * 6/2007 Stridiron et al. ..... 404/84.1
7,287,818 B1 * 10/2007 Hall et al. ..... 299/41.1
7,387,464 B2 * 6/2008 Hall et al. ..... 404/94
7,387,465 B2 * 6/2008 Hall et al. ..... 404/94
7,396,085 B2 * 7/2008 Hall et al. ..... 299/39.1
7,473,052 B2 * 1/2009 Hall et al. ..... 404/75
7,544,011 B2 * 6/2009 Hall et al. ..... 404/111
7,549,821 B2 * 6/2009 Hall et al. ..... 404/75
2006/0204331 A1 * 9/2006 Hall et al. ..... 404/75
2007/0201951 A1 * 8/2007 Stridiron et al. ..... 404/84.1

* cited by examiner

CHECKING DENSITY WHILE COMPACTING

BACKGROUND OF THE INVENTION

Modern road surfaces typically comprise a combination of aggregate materials and binding agents processed and applied to form a smooth paved surface. The type and quality of the pavement components used, and the manner in which the pavement components are implemented or combined, may affect the durability of the paved surface. Even where a paved surface is quite durable, however, temperature fluctuations, weather, and vehicular traffic over a paved surface may result in cracks and other surface or sub-surface irregularities over time. Road salts and other corrosive chemicals applied to the paved surface, as well as accumulation of water in surface cracks, may accelerate pavement deterioration.

Road resurfacing equipment may be used to mill, remove, and/or recondition deteriorated pavement. In come cases, heat generating equipment may be used to soften the pavement, followed by equipment to mill the surface, apply pavement materials, and plane the surface. Often, new pavement materials may be combined with materials milled from an existing surface in order to recondition or recycle existing pavement. Once the new materials are added, the materials may be compacted and planed to restore a smooth paved surface.

U.S. Pat. No. 5,952,561, which is herein incorporated by reference for all that it contains, discloses a real time differential asphalt pavement quality sensor adapted to measure asphalt density in real time using a differential approach. Two sensors, one in the front of a roller and another behind the roller, measure reflected signals from the asphalt. The difference between the reflected signals provides an indication of the optimal compaction and density of the asphalt pavement. The invention looks at the change in variance over successive passes to determine when the optimal level of compaction has been reached.

U.S. Pat. No. 6,287,048 which is herein incorporated by reference for all that it contains, discloses an apparatus having a horizontal compacting roller and a side edge confinement roller or shoe for compacting an asphalt concrete lane. A sensor is on the carrier vehicle for sensing the position of a defined edge of the lane, and a control is provided for steering the carrier vehicle so that the horizontal roller and the edge confinement force roller or shoes follow the defined edge of the lane to provide uniform density.

U.S. Pat. No. 6,577,141 which is herein incorporated by reference for all that it contains, discloses a system and method of determining the density of pavement material. The invention includes positioning a capacitive proximity sensor, adjacent to but not in direct contact with a pavement material, projecting an electrostatic capacitive field from the sensor in the direction of the pavement material, measuring the strength of the electrostatic capacitive field as detected by the sensor, and correlating the strength of the electrostatic capacitive field to the density of the pavement material. The invention further discloses determining a location and associating the location with a pavement material density.

U.S. Pat. No. 6,122,601 which is herein incorporated by reference for all that it contains, discloses a two component system to obtain uniform density of compacted materials and track the compaction of the materials. The first component provides an automated, real-time compaction density meter and method of use to measure the density of the compacted material. The second component provides a Geographic Information System (GIS) for tracking compaction of a surface at specific locations. The two components of the present invention combined provide a system to measure the density of the compacted material and record the location of each density measurement. The components of the present invention can be utilized for many compaction operations, such as the roller compaction of concrete, pavement, soil, landfills, and asphalt pavements.

U.S. Pat. No. 5,952,561 which is herein incorporated by reference for all that is contains, discloses a real time differential asphalt pavement quality sensor adapted to measure asphalt density in real time using a differential approach. Two sensors, one in the front of a roller and another behind the roller, measure reflected signals from the asphalt. The difference between the reflected signals provides an indication of the optimal compaction and density of the asphalt pavement. The invention looks at the change in variance over successive passes to determine when the optimal level of compaction has been reached.

U.S. patent application Ser. No. 11/421,105; which is herein incorporated by reference for all that it contains; discloses a method for recycling a paved surface including the steps of providing a motorized vehicle adapted to traverse a paved surface; providing the motorized vehicle with a plurality of degradation elements, a plurality of foaming elements and a plurality of compacting elements; each plurality being attached to a carriage slidably supported by a bearing surface of an underside of the motorized vehicle; degrading the paved surface with the plurality of degradation elements as the vehicle traverses the paved surface; foaming rejuvenation material by the plurality of foaming elements into the degraded surface as the surface is being degraded; and compacting the degraded surface and the rejuvenation material into a new surface with the plurality of compaction elements as the foaming elements continue to foam rejuvenation material into the degraded surface.

BRIEF SUMMARY OF THE INVENTION

The present invention provides a compaction system with a first and second array of compaction elements supported by an underside of a motorized vehicle adapted to traverse a degraded surface. A sensor assembly is supported by the motorized vehicle, disposed intermediate the first and second array of compaction elements, and in electrical communication with a controller. The sensor assembly also being adapted to sense a characteristic of an at least partially compacted surface formed after the first array of compacting elements applies a first compaction pressure to the degraded surface. The controller may be in electrical communication with the second array of compaction elements and have an input field for a second compaction pressure. The sensor assembly is also adapted to input the second compaction pressure into the field and the controller adjusts the second array of compaction elements to apply the second compaction pressure to the at least partially compacted surface.

In one embodiment the compacting elements may be tampers, rollers, vibrators, and/or plates. The first and second row of compactors as well as the sensor assembly may be in communication with a controller. The sensor assembly may be part of a closed loop system. In one embodiment the controller may have a PC, a microprocessor, a microcontroller, analog circuitry, programmable logic, and/or combinations thereof. The controller may also have electronic components selected from the group consisting of analog filters, digital filters, modems, data input ports, data output ports, power supply, battery's, memory, wireless transceivers, digital/optical converters, optical/digital converters, analog to digital converters (ADC), digital to analog converters (DAC), modulators, demodulators, clocks, amplifiers, and combinations thereof.

The sensor assembly may have density sensors with which the density of the at least partially compacted surface may be measured. The sensor assembly may further include a pressure sensors, position sensors, compressive strength sensor, porosity sensor, pH sensor, electric resistively sensor, inclination sensor, nuclear sensor, acoustic sensor, velocity sensor, moisture sensor, capacitance sensor, and combinations thereof. The sensor assembly may be flexibly coupled to the motorized vehicle and be adapted for stationary placement while the motorized vehicle traverses the roadway.

The sensor assembly may also have an actuating element selected from the group consisting of hydraulic actuators, a rack and pinion gear, a smart material actuator, an electric actuator or combinations thereof. One use for the actuator may include making the sensor assembly movable with respect to the rest of the vehicle longitudinally along the axis of the vehicle or transversely normal to the axis, or combinations thereof. Actuators may also be used for pivotable movement of the sensor assembly.

The sensor assembly may also have electronic components selected from the group consisting of analog filters, digital filters, modems, data input ports, data output ports, power supply, battery's, memory, wireless transceivers, digital/optical converters, optical/digital converters, analog to digital converters (ADC), digital to analog converters (DAC), modulators, demodulators, clocks, amplifiers, processors, and combinations thereof.

A method of compacting a rejuvenated mix, including the steps of providing a motorized vehicle adapted to traverse a paved surface; providing a sensor assembly intermediate a first and second row of compaction elements; compacting the rejuvenated mix with the first row of compaction elements with a first compressive force; acquiring a characteristic of the compacted rejuvenated mix; determining from the characteristic an adjusted compressive force for the second row of compaction elements; compacting the rejuvenated mix with the second row of compaction elements using the adjusted compressing force.

DETAILED DESCRIPTION OF THE INVENTION AND THE PREFERRED EMBODIMENT

In this application, "pavement" or "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, polymeric materials, sand, polyester fibers, Portland cement, petrochemical binders, or combinations thereof. Likewise, rejuvenation materials refer to any of various binders, oils, and resins, including bitumen, surfactant, polymeric materials, emulsions, asphalt, tar, cement, oil, pitch, or combinations thereof. Reference to aggregates refers to rock, crushed rock, gravel, sand, slag, soil, cinders, minerals, or other course materials, and may include both new aggregates and aggregates reclaimed from an existing roadway. Likewise, the term "degrade" or "degradation" is used in this application to mean milling, grinding, cutting, ripping apart, tearing apart, or otherwise taking or pulling apart a pavement material into smaller constituent pieces.

Figure 1:
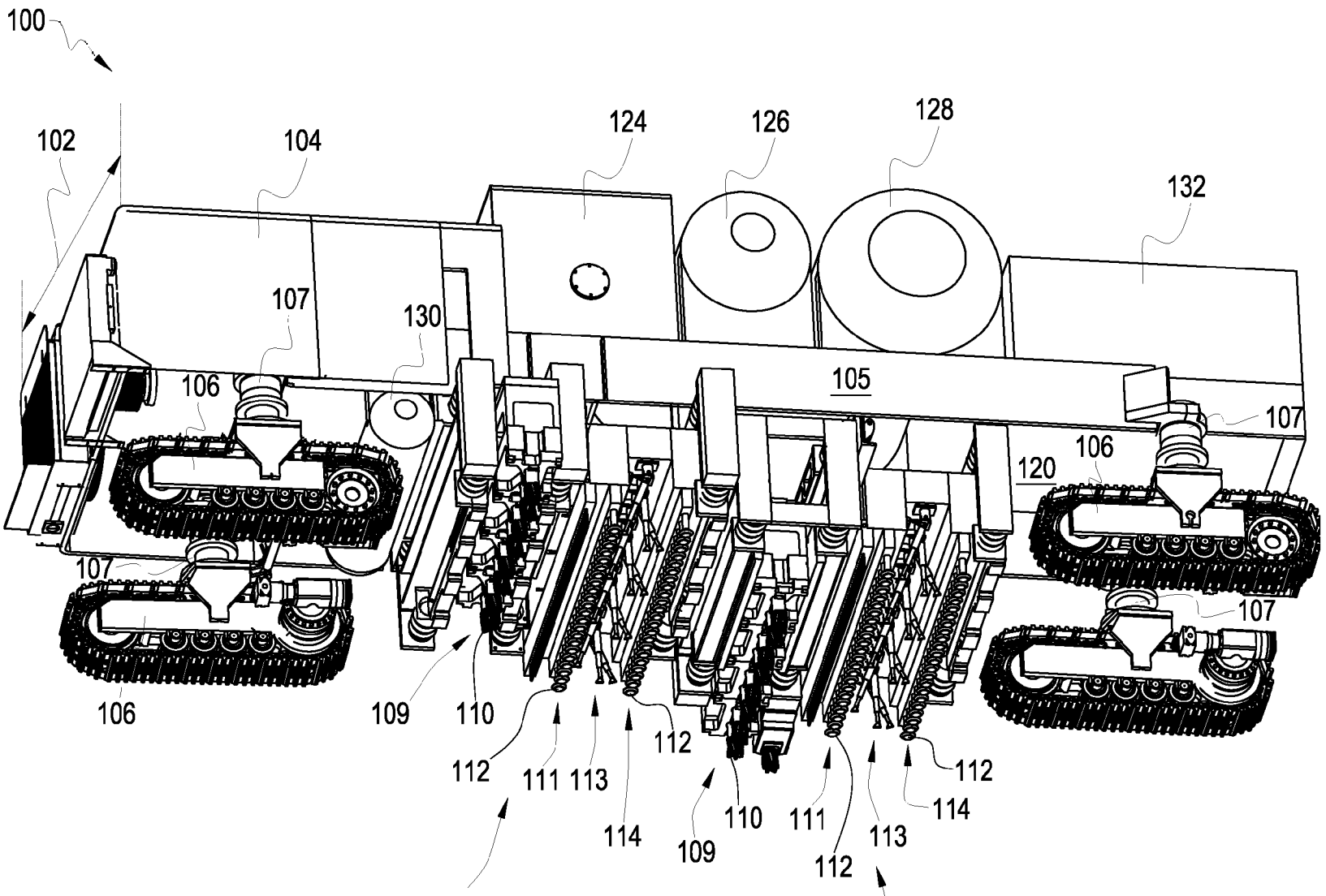
FIG. 1 is a perspective diagram of an embodiment of a motorized vehicle for on site recycling of asphalt.

Referring to FIG. 1, in selected embodiments, a motorized vehicle 100 may be adapted to degrade and recycle a section of pavement substantially wider than the vehicles width 102. The motorized vehicle 100 may include a shroud 104, covering various internal components of the motorized vehicle 100, a frame 105, and a translational element 106 such as tracks, wheels, or the like, to translate or move the vehicle 100, such translational elements being well known to those skilled in the art. The motorized vehicle 100 may also include means 107 for adjusting the elevation and slope of the frame 105 relative to the translational element 106 to adjust for varying elevations, slopes, and contours of the underlying road surface.

In selected embodiments, to facilitate degradation of a swath of pavement wider than the motorized vehicle 100, the vehicle 100 may include one or more slidable carriages 108 supported by a bearing surface 120 of an underside of the motorized vehicle 100 capable of extending beyond the outer edge of the vehicle 100. In some embodiments, the carriages 108 may be as wide as the vehicle 100 itself, the carriages 108 may sweep over a width approximately twice the vehicle width 102 or more. These carriages 108 may include banks 109 of pavement degradation elements 110 that rotate about an axis substantially normal to a plane defined by a paved surface. Each of these pavement degradation elements 110 may be used to degrade a paved surface in a direction substantially normal to their axes of rotation. The slidable carriages 108 may further comprise a first array 111 of compacting elements 112 followed by a sensor assembly 113 and then a second array 114 of compaction elements 112.

Under the shroud 104, the motorized vehicle 100 may include an engine and hydraulic pumps for powering the translational elements 106, the carriages 108, the pavement degradation elements 110, or other components. Likewise, the vehicle 100 may include a tank 124 for storing hydraulic fluid, a fuel tank 126, a tank 128 for storing rejuvenation materials such as asphalt, bitumen, oil, tar, or the like, a water tank 130, and a hopper 132 for storing aggregate such as gravel, rock, sand, pebbles, macadam, concrete, or the like.

Figure 2:
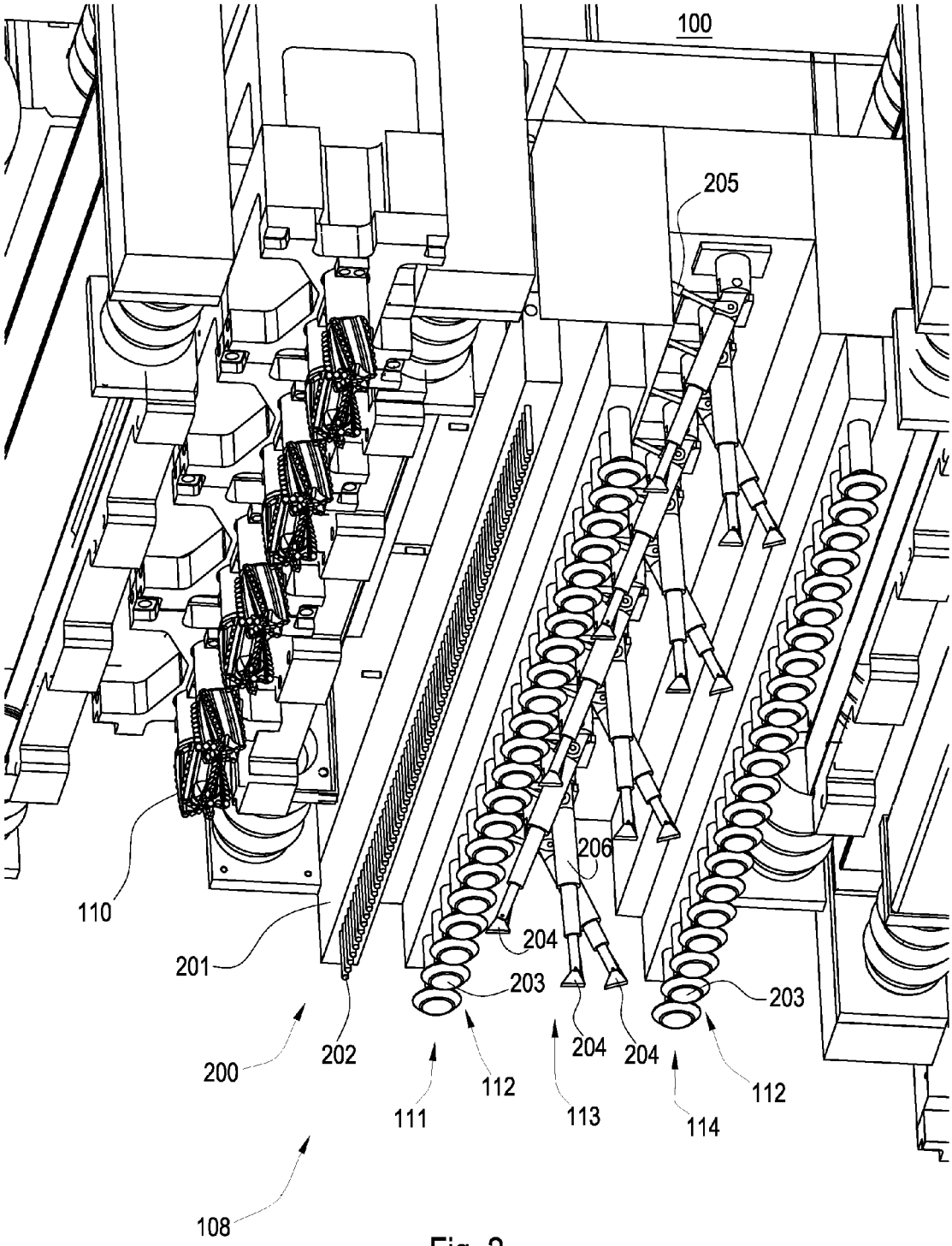
FIG. 2 is a perspective diagram of an embodiment of a slidable carriage.

FIG. 2 is a diagram of an embodiment of the slidable carriage 108. To extend the carriages 108 beyond the outer edge of the motorized vehicle 100, each of the carriages 108 may include actuators (not shown), such as hydraulic cylinders, pneumatic cylinders, or other mechanical devices known to those of skill in the art, to move the carriages 108 to each side of the vehicle 100. Each carriage 108 may also include a rake 200 to level, smooth, and mix pavement aggregates, including new aggregates and reclaimed aggregates generated by the pavement degradation elements 110. As illustrated, a rake 200 may include a housing 201 comprising multiple foaming elements 202 extending therefrom. In selected embodiments, each of the foaming elements 202 may be independently extended and retracted relative to the housing 201. This feature may allow the foaming elements 202 to be retracted to avoid obstacles such as manholes, grates, railroad tracks, or other obstacles in the roadway. In certain embodiments, each of the foaming elements 202 may be hollow to accommodate a flow of pavement rejuvenation materials for deposit on a road surface.

Pavement rejuvenation materials may include, for example, asphalt, bitumen, tar, oil, water, combinations thereof, or other suitable materials, resins, and binding agents. These rejuvenation materials may be mixed with various aggregates, including new aggregates and reclaimed aggregates generated by the pavement degradation elements 110. The resulting mixture may then be smoothed and compacted to form a recycled road surface. In selected embodiments, the rake 200 may move side-to-side, front-to-back, in a circular pattern, vibrate, or the like to aid in mixing the resulting mixture of aggregates and rejuvenation materials. In certain embodiments, each carriage 108 may include a first array 111 of compacting elements 112 to compact the mix following which a sensor assembly 113 may measure the density of the compacted mix. A second array 114 of compaction elements 112 may then adjust there compaction pressure and/or displacement in order to compact the mix to a desired density. In the current embodiment the compacting elements 112 are tampers 203. Like the foaming elements 202, the tampers 203 may, in certain embodiments, be independently extendable and retractable relative to the carriage 108.

The sensor assembly 113 may comprise one or more density sensors 204 attached to actuators 205 adapted to place the sensors 204 on the partially compacted mix for a period of time after being compacted by the first array 111 of compaction elements 112. The actuators 205 may adjust the sensors 204 such that they may move longitudinally along the axis of the vehicle, transversely normal to the axis, or combinations thereof. Actuators 206 may also be placed on the assembly 113 to control the height of the sensors 204 with respect to the partially compacted mix.

Figure 3:
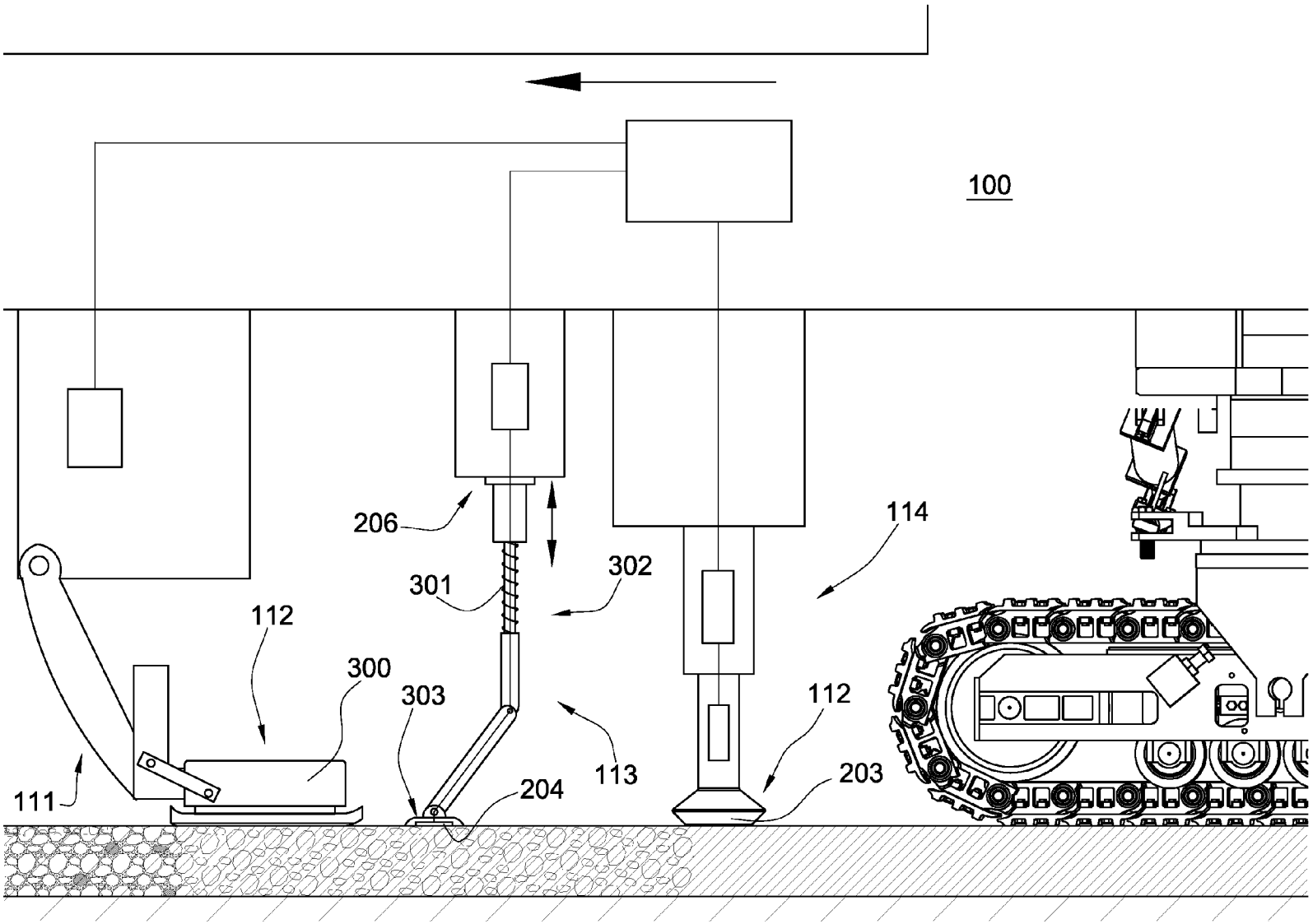
FIG. 3 is a perspective diagram of a section of an embodiment of a motorized pavement resurfacing vehicle.

FIG. 3 diagrams an embodiment of the first 111 and second array 114 of compaction elements 112 and the sensor assembly 113. In the present embodiment the first array 111 of compaction elements 112 are plate compactors 300. The plate compactors 300 may vibrate or have applied pressure to compact the mix. A plate compactor 300 may help smooth the mix and provide a fairly level surface. Following the plate compactor 300 a sensor assembly 113 may be attached to the motorized vehicle 100. In one embodiment the sensor assembly 113 may be flexibly coupled to the motorized vehicle 100. In the current embodiment, a spring loaded or hydraulic shock 301 flexibly couples an extendable leg 302 to the motorized vehicle 100. A sensor 204 for measuring density may be attached to a foot 303 of the extendable leg 302. This type of configuration may allow the density sensor 204 to be less effected by the vibration of the motorized vehicle 100 as well as the vibrations from the degrading elements 110, foaming elements 202, and the compacting element 112. The spring loaded shock 301 may also help prevent damage to the sensors 204 on rougher surfaces. In one embodiment the actuators 206 adapted to extend and retract the leg 302 may be capable of filtering out the vibrations from the motorized vehicle 100. The second array 114 of compaction elements 112 may comprise tampers 203 that may apply a variable force and a variable displacement dependent upon the density measured by the sensors 204.

Figure 4:
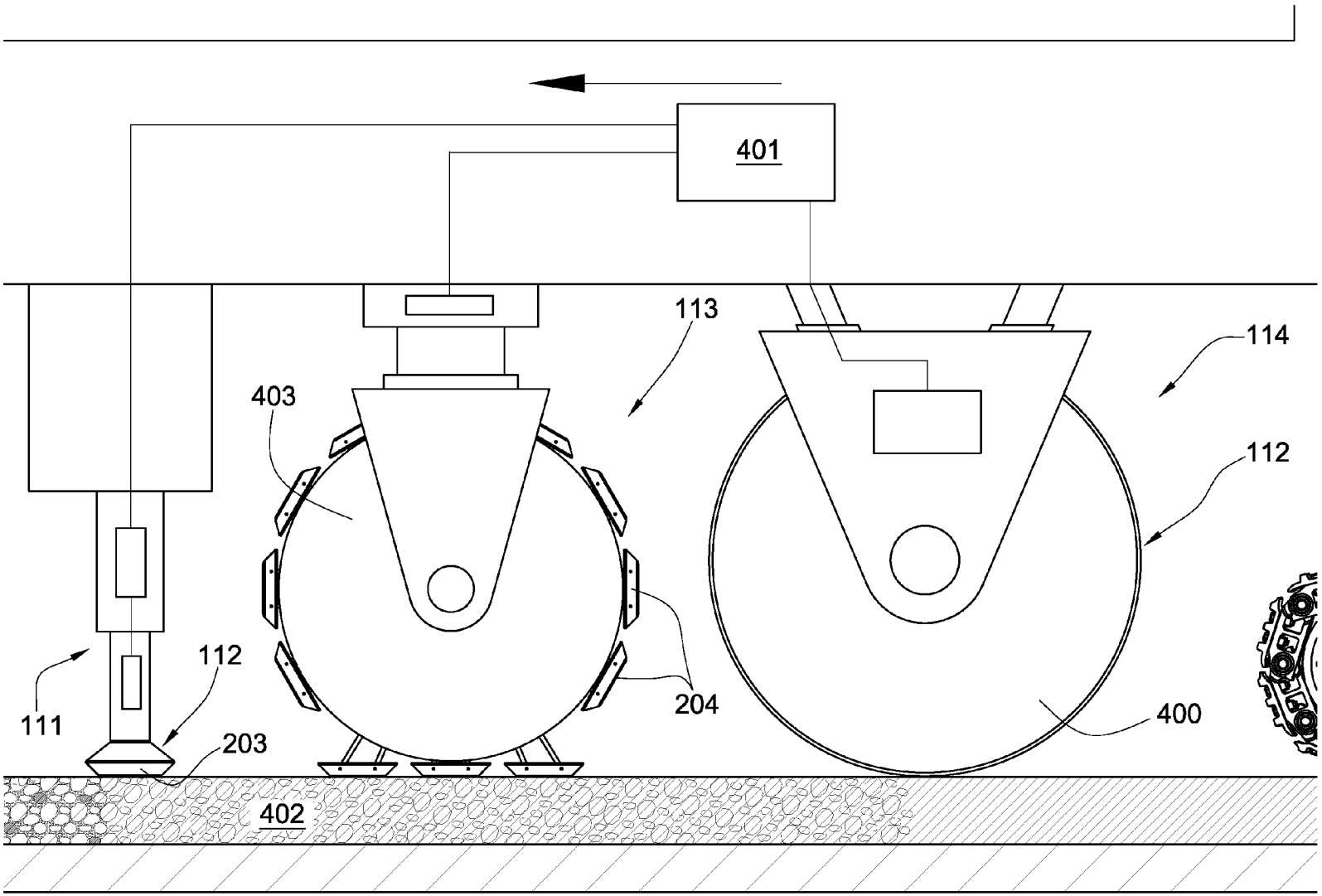
FIG. 4 is a perspective diagram of a section of an embodiment of a motorized pavement resurfacing vehicle.

FIG. 4 diagrams an alternate embodiment of the first 111 and second array 114 of compaction elements 112 and the sensor assembly 113. The first array 111 of compaction elements 112 comprises tampers 203 and the second array 114 of compaction elements 112 comprises one or more rollers 400. The tampers 203 may apply a first compaction pressure determined by a controller 401 to the mix 402. The compaction pressure may be designated such that the mix 402 is evenly distributed and relatively smooth on the surface. The density of the partially compacted mix 402 may then be measured with the sensor assembly 113. The sensor assembly 113 may then send a data signal to the controller 401 comprising the density measurements. The controller 401 may then send a data signal to an input field of the second assembly 114 of compaction elements 112. From the input field the compaction pressure of the second array 114 of compaction elements 112 may be set. The compaction pressure of rollers 400 may be adjusted by altering the height of the rollers 400 with respect to the vehicle 100. A maximum pressure may be applied by the rollers 400 if they are extended to the point where the back translational elements 106 are lifted off of the ground. At this point a large part of the weight of the vehicle may be on the rollers 400. In the current embodiment the sensor assembly 114 comprises a wheel/track 403 with multiple sensors 204 attached around its circumference. The sensors 204 may be extendable from the wheel/track 403 allowing the sensor 204 to be on the surface of the mix 402 for an extended period of time. With more time to make a measurement the sensors 204 may be more accurate. This configuration may also allow the vehicle to move forward while a sensor 204 remains stationary so that measurements that require an extended period of time may be taken.

Figure 5:
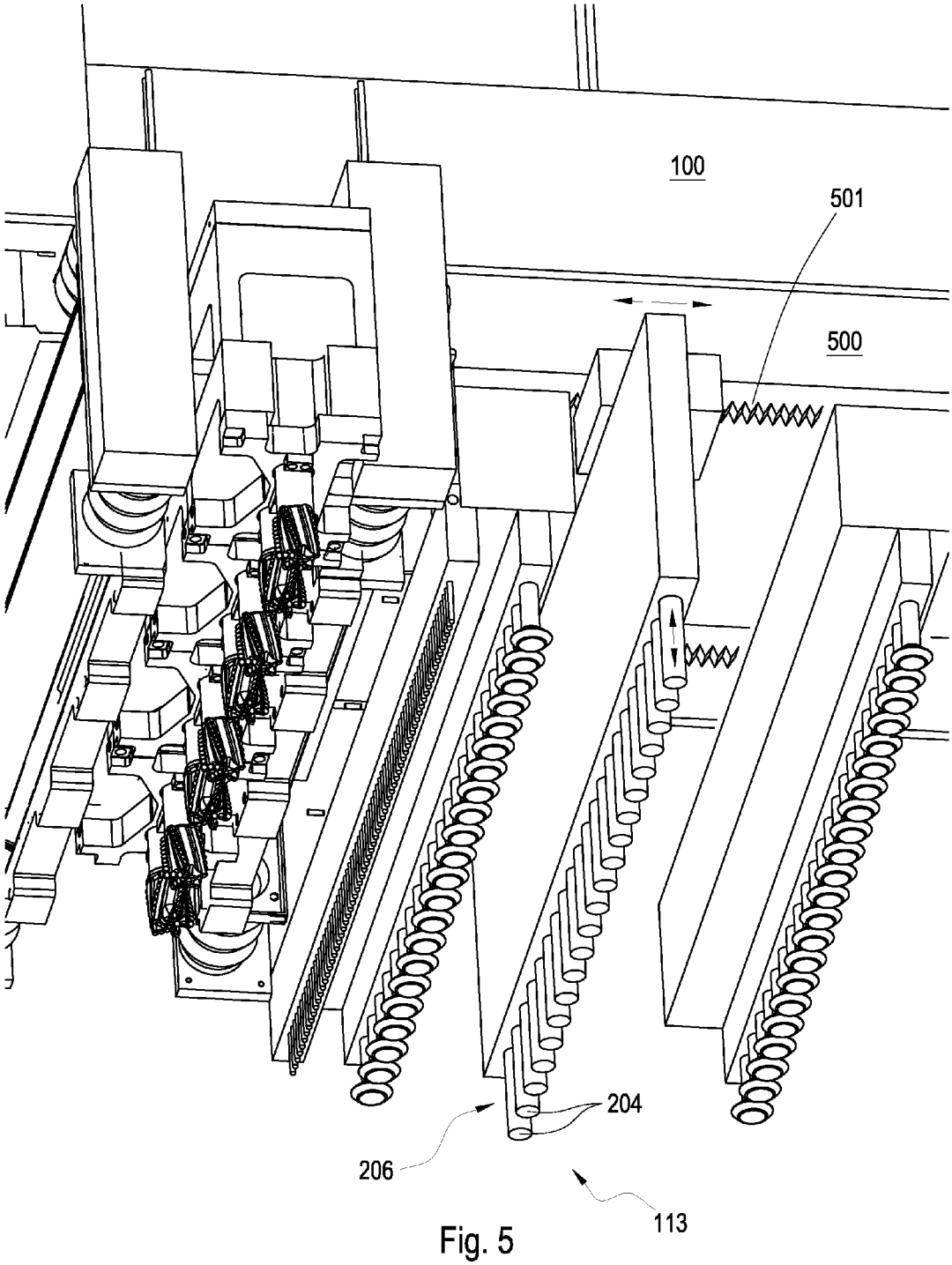
FIG. 5 is a perspective diagram of an embodiment of a slidable carriage.

FIG. 5 is a diagram of an alternate embodiment of the pavement recycling vehicle 100. The sensor assembly 113 is slidably mounted on a chassis 500 comprising a rack gear 501. The sensor assembly 113 may comprise a pinion gear and motor (not shown) which when turned may move the sensor assembly 113 along the underside of the vehicle 100. The sensor assembly 113 may be capable of moving forward towards the front of the vehicle 100 or reverse towards the rear of the vehicle 100 depending on the direction the pinion gear is turned. Sensors 204 may be mounted on actuating elements 206 that extend toward the ground. The actuating elements 206 may be hydraulic actuators, a rack and pinion gear, a smart material actuator that extend or retracts based on an applied electric or magnetic field, an electric actuator or combinations thereof. Sensors 204 that may be used include density sensors, pressure sensors, position sensors, compressive strength sensor, porosity sensor, pH sensor, electric resistively sensor, inclination sensor, nuclear sensor, acoustic sensor, velocity sensor, moisture sensor, capacitance sensor, and combinations thereof.

Figure 6:
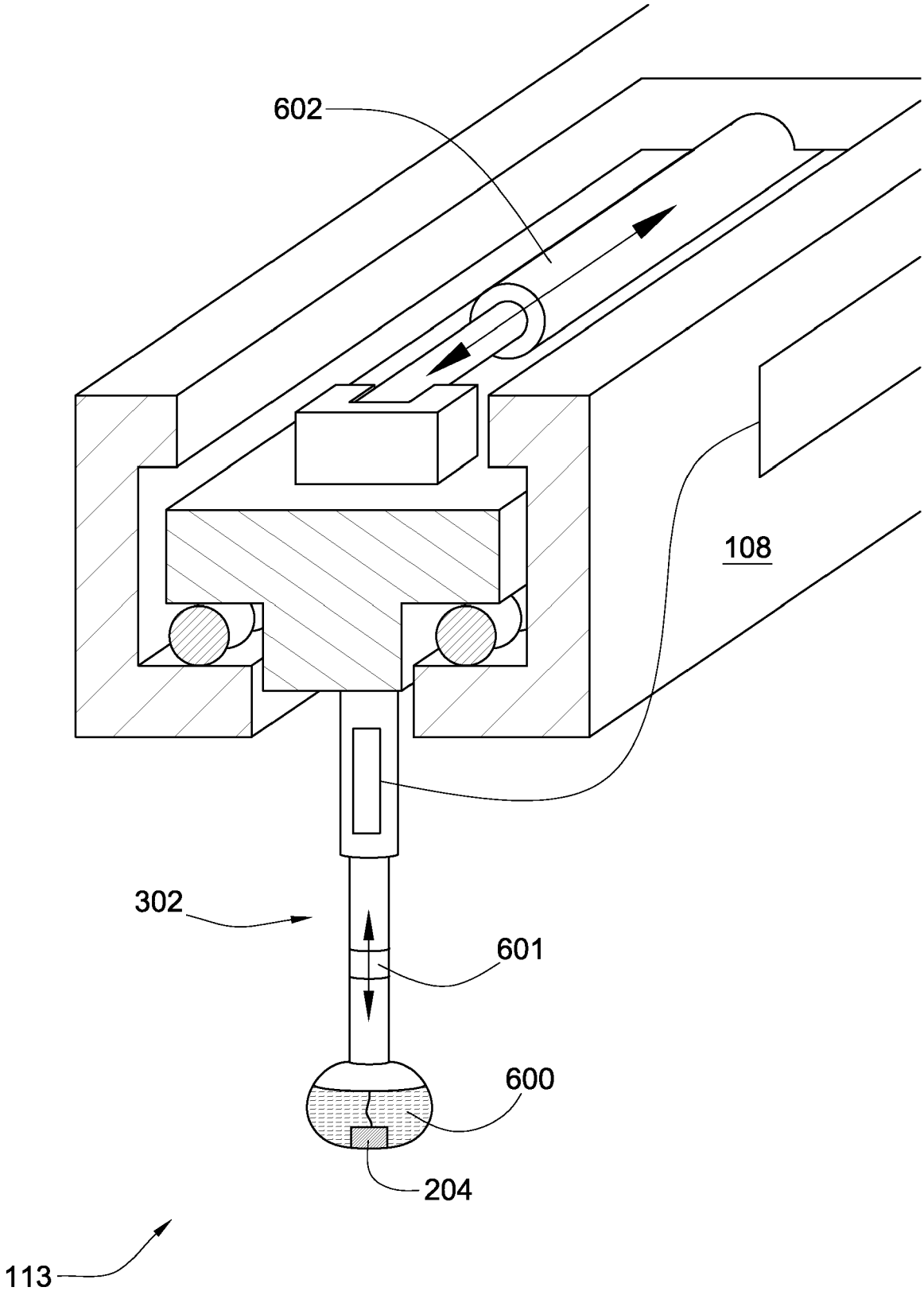
FIG. 6 is a perspective diagram of an embodiment of a sensor assembly.

FIG. 6 is a diagram of and embodiment of a sensor assembly 113. In the current embodiment the sensor 204 is adapted for stationary placement while the motorized vehicle 100 traverses the roadway. The sensor 204 may be positioned inside of a rubber, foam, or other flexible medium 600 in order to reduce the amount of vibrations transferred from the vehicle 100 to the sensor 204. Other embodiments may include placing a segment of foam, rubber, or other shock absorbing material 601 on the leg 302 of the sensor assembly 113. The sensor assembly 113 may be slidably mounted to a carriage 108 on the motorized vehicle 100. In the current embodiment the sensor assembly 113 may extend the leg 302 until the sensor 204 is the desired distance from the ground. In some cases the shock absorbing material 601 and/or sensor 204 may be extended to the point that it is in contact with the ground. The friction created between the sensor 204 and/or shock absorbing material 601 and ground may provide enough force to keep the sensor 204 in place as the vehicle 100 moves forward. Once the sensor assembly 113 reaches the end of the carriage 108, a hydraulic cylinder 602 may be used to push the assembly 113 back to a starting position. The hydraulic cylinder 602 may then retract and allow friction between the ground and assembly 113 keep the sensor 204 stationary while measurements are taken. Other embodiments (not shown) may include attaching the hydraulic cylinder 602 to the sensor assembly 113 and retracting the cylinder 602 according to the speed that the vehicle 100 is traveling.

Figure 7:
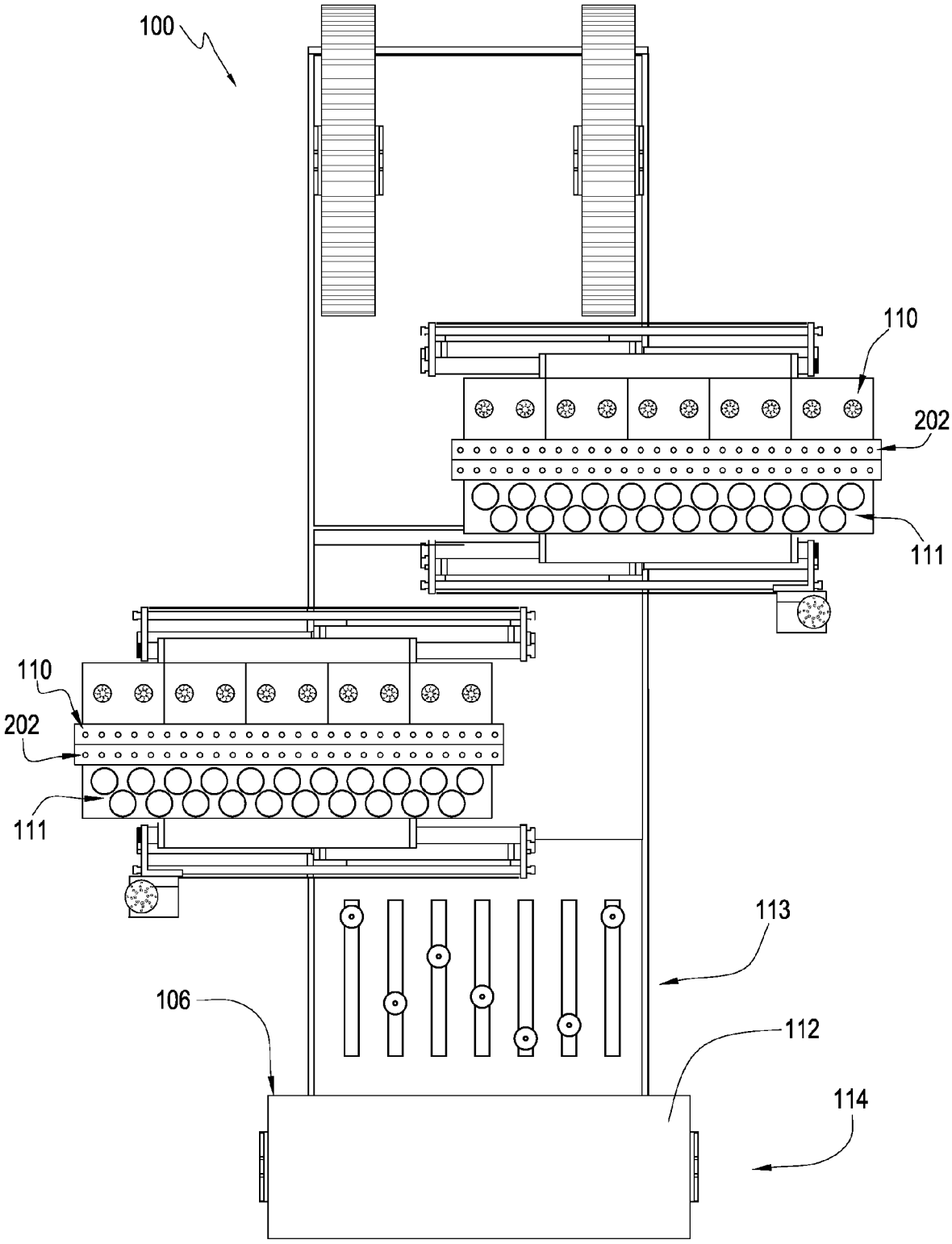
FIG. 7 is a perspective diagram of an embodiment of an underside of a motorized pavement resurfacing vehicle.

FIG. 7 diagrams the underside of a motorized vehicle 100 with a sensor assembly 113 as described in FIG. 6. In one embodiment the sensor assembly 113 may be attached to the carriage 108 comprising the first row 111 of compaction elements 112, foaming elements 202, and degrading elements 110 or be independent. In the present embodiment the back translational element 106 may also be the second row 114 of compaction elements 112. This may help decrease the overall length of the pavement resurfacing vehicle 100.

Figure 8:
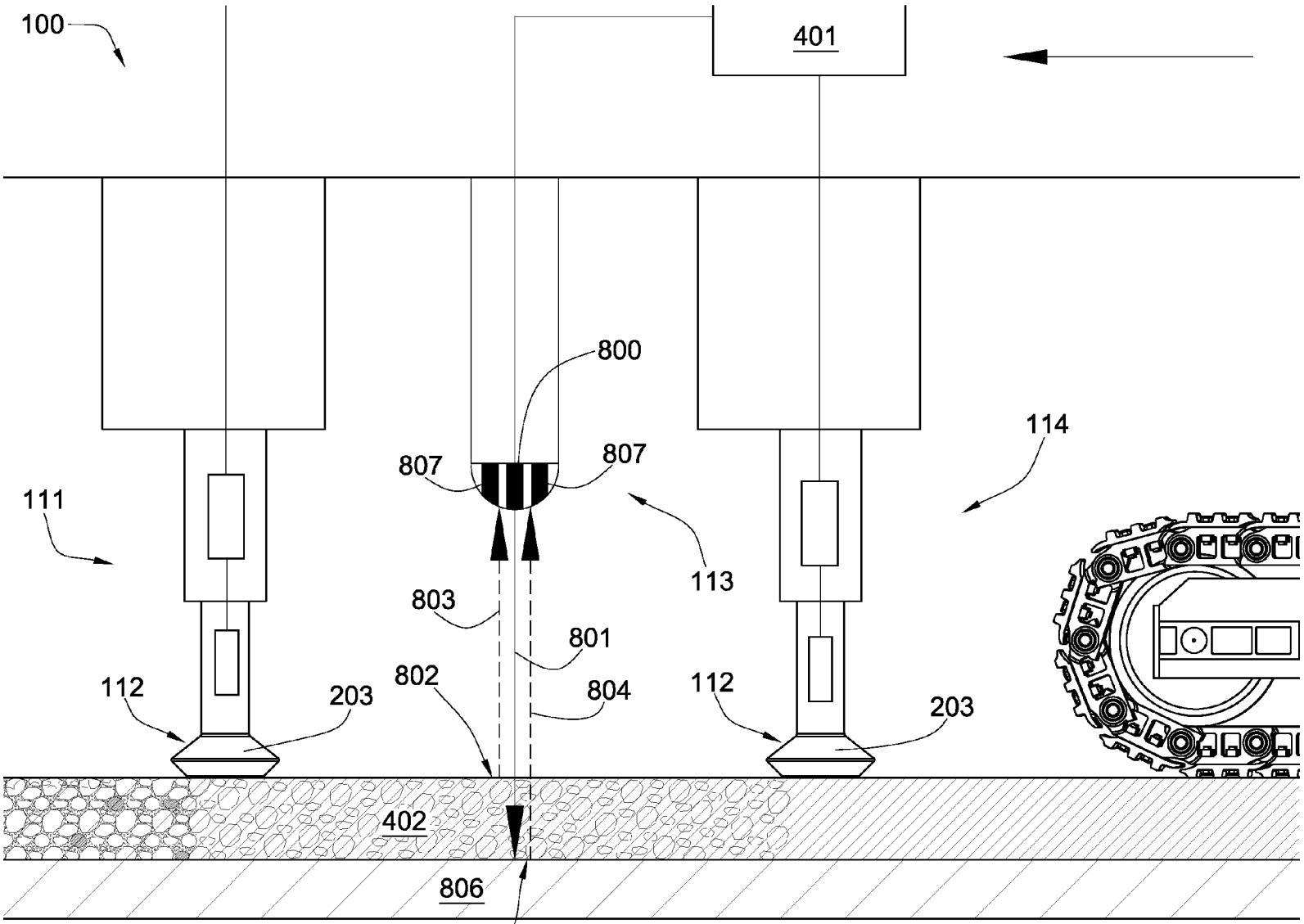
FIG. 8 is a perspective diagram of a section of an embodiment of a motorized pavement resurfacing vehicle.

FIG. 8 is a diagram of the sensor assembly 113 and first 111 and second row 114 of compaction elements 112. In the present embodiment the sensor assembly 113 may be a part of a closed loop system. The first array 111 of compaction elements 112 may receive an input parameter from the controller 401 designating the compaction pressure of the tampers 203. In the present embodiment the sensor assembly 113 may comprise an optical and/or acoustic transducer 800. The transducer 800 may emit a signal 801 towards the compacted mix 402. Once the signal 801 reaches a first boundary 802 between the air and mix 402 a reflection 803 may occur. A second reflection 804 may take place at a second boundary 805 between the newly at least partially compacted mix 402 and the under layer 806 of pavement. The sensor assembly 113 may also be adapted to receive the reflections 803, 804 using an acoustic and/or optical sensor 807. The received reflections 803, 804 may be converted to an analog or digital electrical signal or left as an optical or acoustic signal for processing by the controller 401. The signals may be filtered and amplified before being sent to the controller 401. The controller 401 may then be able to determine a parameter of the newly compacted mix 402 by comparing the phase, intensity, and delay time between the two received reflections 803, 804 and/or comparing the received reflections 803, 804 to a known reference. From the comparison the density of the newly compacted mix 402 may be determined. Once the density is known the controller 401 may send a signal specifying the second compaction pressure to the second row 114 of compaction elements 112 to further compact the mix 402 so that it reaches a desired density. The controller 401 may be a PC, a microprocessor, a microcontroller, analog circuitry, programmable logic, and/or combinations thereof.

Figure 9:
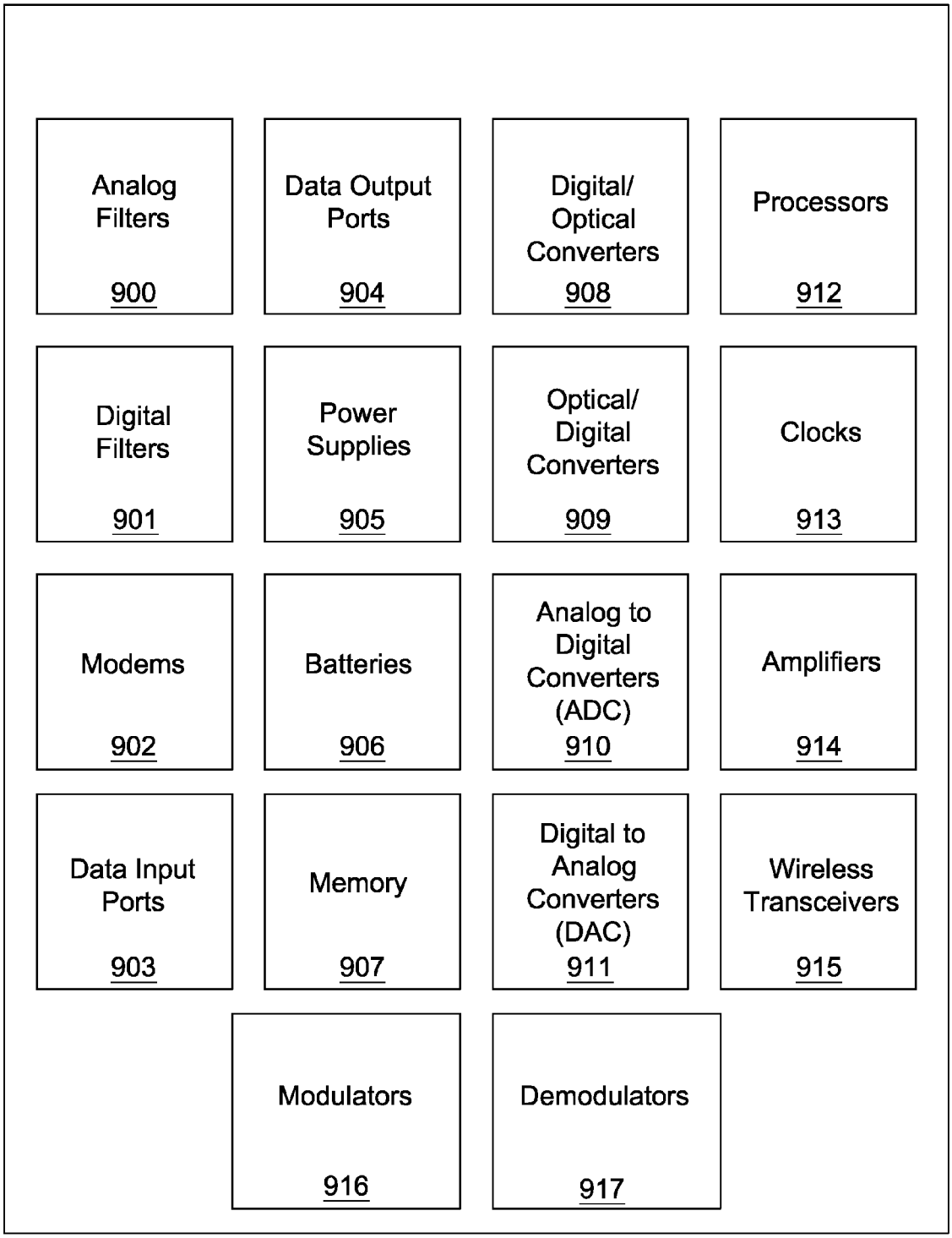
FIG. 9 is a block diagram of electronic components that may be used within the sensor assembly, controller or actuating elements.

FIG. 9 diagrams further electronic components 900 that may be used within the sensor assembly 113, controller 401 and actuating elements 206. The electronic components may include analog filters 900, digital filters 901, modems 902, data input ports 903, data output ports 904, power supplies 905, batteries 906, memory 907, digital/optical converters 908, optical/digital converters 909, analog to digital converters (ADC) 910, digital to analog converters (DAC) 911, processors 912, clocks 913, amplifiers 914, wireless transceivers 915, modulators 916, demodulators 917 and combinations thereof.

Figure 10:
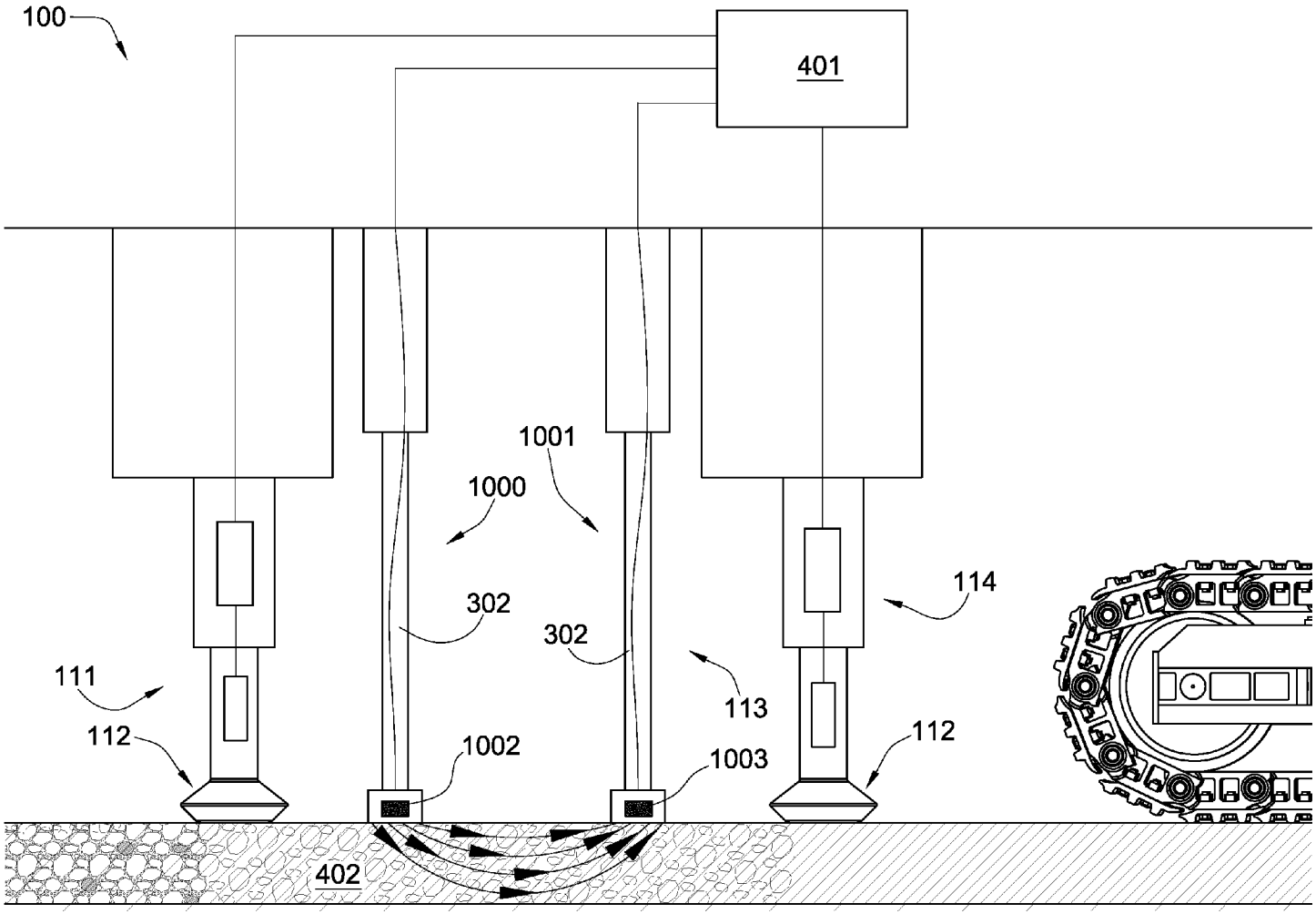
FIG. 10 is a perspective diagram of a section of an embodiment of a motorized pavement resurfacing vehicle.

FIG. 10 is a diagram of an embodiment of the sensor assembly 113 and first 111 and second row 114 of compacting elements 112. The sensor assembly 113 comprises a first 1000 and second set 1001 of legs 302, the first 1000 comprising an emitter 1002 and the second 1001 comprising a receiver 1003. The emitter 1002 may be a gamma source, a neutron source, a current source, a voltage source or combinations thereof. The receiver 1003 may acquire the energy emitted from the corresponding source and relay information to the controller 401 regarding the received information. From the information the controller 401 may be able determine a parameter of the mix 402 including; density, receptivity, conductivity, capacitance and combinations thereof. In other embodiments the legs 302 may be used to measure parameters of the mix 402 including but not limited to; pressure, position, compressive strength, porosity, pH, inclination, nuclear properties, acoustical properties, velocity, moisture content or combinations thereof. Combinations of sensors may be used in conjunction with one another to obtain multiple parameters of the compacted mix 402 simultaneously. One such combination may include a density sensor and an inclination sensor. The density sensor may ensure that the mix 402 is compacted to the desired density while the inclination sensor may sense changes in the grade of the pavement and the compaction elements 112 may adjust accordingly.

Figure 11:
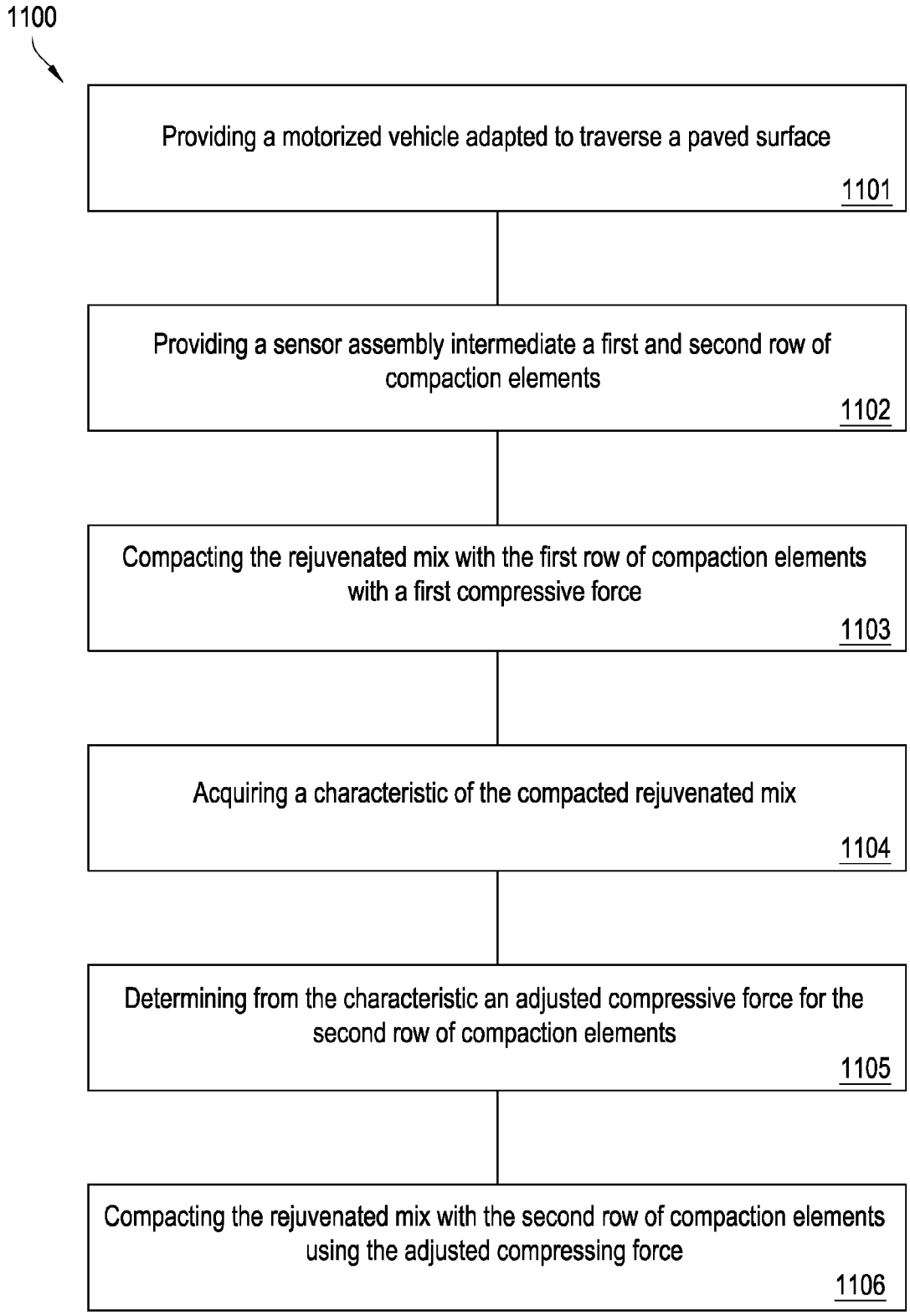
FIG. 11 is a block diagram of an embodiment of a method for recycling a paved surface.

FIG. 11 is a block diagram of a method 1100 for compacting rejuvenated mix comprising the steps of providing 1101 a motorized vehicle adapted to traverse a paved surface; providing 1102 a sensor assembly intermediate a first and second row of compaction elements; compacting 1103 the rejuvenated mix with the first row of compaction elements with a first compressive force; acquiring 1104 a characteristic of the compacted rejuvenated mix; determining 1105 from the characteristic an adjusted compressive force for the second row of compaction elements; compacting 1106 the rejuvenated mix with the second row of compaction elements using the adjusted compressing force.

Whereas the present invention has been described in particular relation to the drawings attached hereto, it should be understood that other and further modifications apart from those shown or suggested herein, may be made within the scope and spirit of the present invention.

What is claimed is:

1. A compaction system, comprising:

a first and second array of compaction elements supported by an underside of a motorized vehicle adapted to traverse a degraded surface;

a plurality of pavement degradation elements supported by the underside that rotate about an axis substantially normal to the degraded surface;

a sensor assembly supported by the motorized vehicle, disposed intermediate the first and second array of compaction elements, and in electrical communication with a controller;

the sensor assembly also being adapted to sense a characteristic of an at least partially compacted surface formed after the first array of compacting elements applies a first compaction pressure to the degraded surface;

the controller being in electrical communication with the second array of compaction elements and comprising an input field for a second compaction pressure;

wherein the sensor assembly is adapted to input the second compaction pressure into the field and the controller is adapted to adjust the second array of compaction elements to apply the second compaction pressure to the at least partially compacted surface.

2. The system of claim 1, wherein the compacting elements are tampers, and/or plates.

3. The system of claim 1, wherein the sensor assembly is part of a closed loop system.

4. The method of claim 1, wherein the sensor assembly and first and second row of compaction elements are in communication with a controller.

5. The system of claim 1, wherein the sensor assembly further comprises density sensors, pressure sensors, position sensors, compressive strength sensor, porosity sensor, pH sensor, electric resistively sensor, inclination sensor, nuclear sensor, acoustic sensor, velocity sensor, moisture sensor, capacitance sensor, and combinations thereof.

6. The system of claim 1, wherein the controller comprises a PC, a microprocessor, a microcontroller, analog circuitry, programmable logic, and/or combinations thereof.

7. The system of claim 1, wherein the controller further comprises electronic components selected from the group consisting of analog filters, digital filters, modems, data input ports, data output ports, power supply, batteryies, memory, wireless transceivers, digital/optical converters, optical/digital converters, analog to digital converters (ADC), digital to analog converters (DAC), modulators, demodulators, clocks, amplifiers, and combinations thereof.

8. The system of claim 1, wherein the determined characteristic of the at least partially compacted surface is density.

9. The system of claim 1, wherein the sensor assembly is adapted for stationary placement while the motorized vehicle traverses the roadway.

10. The system of claim 1, wherein the sensor assembly is flexibly coupled to the motorized vehicle.

11. The system of claim 1, wherein the sensor assembly comprises an actuating element selected from the group consisting of hydraulic actuators, a rack and pinion gear, a smart material actuator, an electric actuator or combinations thereof.

12. The system of claim 1, wherein the sensor assembly is movable with respect to the rest of the vehicle longitudinally along the axis of the vehicle or transversely normal to the axis, or combinations thereof.

13. The system of claim 1, wherein the sensor assembly is pivotable.

14. The system of claim 1, wherein the sensor assembly comprises electronic components selected from the group consisting of analog filters, digital filters, modems, data input ports, data output ports, power supply, batteryies, memory, wireless transceivers, digital/optical converters, optical/digital converters, analog to digital converters (ADC), digital to analog converters (DAC), modulators, demodulators, clocks, amplifiers, processors, and combinations thereof.

* * * * *